US009267375B2

(12) United States Patent
Kashyap et al.

(10) Patent No.: US 9,267,375 B2
(45) Date of Patent: Feb. 23, 2016

(54) DEVICE FOR ROOF SUPPORT OF UNDERGROUND MINE/TUNNEL

(75) Inventors: Sudhir Kumar Kashyap, Jharkand (IN); Amalendu Sinha, Jharkand (IN)

(73) Assignee: Council of Scientific & Industrial Research, New Delhi (IN)

( * ) Notice: Subject to any disclaimer, the term of this patent is extended or adjusted under 35 U.S.C. 154(b) by 29 days.

(21) Appl. No.: 13/579,631

(22) PCT Filed: Jan. 31, 2011

(86) PCT No.: PCT/IB2011/000128

§ 371 (c)(1),
(2), (4) Date: Oct. 18, 2012

(87) PCT Pub. No.: WO2011/101716

PCT Pub. Date: Aug. 25, 2011

(65) Prior Publication Data

US 2013/0039704 A1 Feb. 14, 2013

(30) Foreign Application Priority Data

Feb. 19, 2010 (IN) ..... 374/DEL/2010

(51) Int. Cl.

| | |
|---|---|
| ***E21D 15/00*** | (2006.01) |
| ***E21D 15/46*** | (2006.01) |
| ***E21D 15/56*** | (2006.01) |
| ***E21D 15/58*** | (2006.01) |

(52) U.S. Cl.

CPC ..... *E21D 15/46* (2013.01); *E21D 15/56* (2013.01); *E21D 15/581* (2013.01); *E21D 15/585* (2013.01)

(58) Field of Classification Search

CPC ..... E21D 15/46; E21D 15/56; E21D 15/581; E21D 15/585

USPC ..... 405/288, 290; 299/11, 12; 248/351, 248/354.1, 354.3, 188.5

See application file for complete search history.

(56) References Cited

U.S. PATENT DOCUMENTS

| | | | | |
|---|---|---|---|---|
| 3,995,905 | A * | 12/1976 | Jamison | 299/11 |
| 5,967,702 | A * | 10/1999 | Vogelzang | 405/290 |
| 6,129,484 | A * | 10/2000 | Chiaves | 405/134 |
| 7,717,649 | B2 * | 5/2010 | Li et al. | 405/290 |
| 2002/0031407 | A1 * | 3/2002 | Voss et al. | 405/290 |
| 2004/0223815 | A1 | 11/2004 | Stankus et al. | 405/288 |

FOREIGN PATENT DOCUMENTS

| | | | |
|---|---|---|---|
| GB | 747266 | 3/1956 | 20/2 |
| GB | 767626 | 2/1957 | 20/2 |
| GB | 810036 | 3/1959 | 20/2 |

(Continued)

*Primary Examiner* — Thomas B Will
*Assistant Examiner* — Katherine Chu
(74) *Attorney, Agent, or Firm* — Drinker Biddle & Reath LLP

(57) ABSTRACT

The present invention provides a device useful for supporting underground mine/tunnels. The device continuously monitors the roof load coming over the canopy and correspondingly yielding/convergence indicated by the pointer on graduate scale. The roof load coming on the canopy (9) is transmitted to the prop via a set of steel disc springs (5) to increase the yielding and longevity of the present device. The present invention has mechanism for preloading upto the desired load. It is a simple, easily transportable and user friendly device having quick release mechanism from a safe distance.

17 Claims, 13 Drawing Sheets

(56) References Cited

FOREIGN PATENT DOCUMENTS

| | | | | |
|---|---|---|---|---|
| GB | 900592 | 7/1962 | ..... | 20/2 |
| GB | 1552223 | 9/1979 | ..... | E21D 15/14 |
| GB | 2177476 A * | 1/1987 | | |
| GB | 2209549 A * | 5/1989 | | |

* cited by examiner

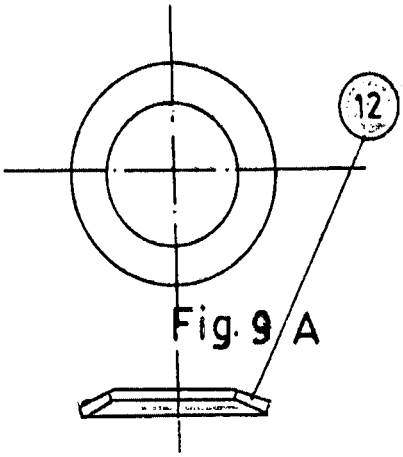
Fig. 9 A
Fig. 9
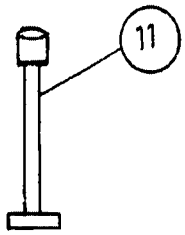
Fig 10

DEVICE FOR ROOF SUPPORT OF UNDERGROUND MINE/TUNNEL

FIELD OF THE INVENTION

The present invention relates to a device for roof support of underground mine/tunnel. The present invention particularly relates to a mine support device which additionally providing unique yielding mechanism, continuous monitoring of roof load of underground mine/tunnels/roadways with simple, easy and safe remote release mechanism.

BACKGROUND AND PRIOR ART

In general, underground mine/tunnels/roadways are supported, especially in India, by using wooden cogs/props as support. But as wood is becoming scarce, there is need for suitable alternative supports to replace timbers in mines. Keeping in mind the Indian mining condition the support should be of greater longevity, light enough for easy portability and requiring less maintenance. Further, it should have facilities for height variation, sufficient yielding, continues load monitoring and releasing remotely as the coal seam thickness varies widely in Indian mines. Then, the support material must be easily available and should have ease in operation by even an unskilled worker. Finally, the device must be economically viable for Indian mines, which is thriving for its longer life and should provide safety for miners. In this direction several efforts have been made as can be seen from a survey of the hitherto known prior art.

Reference may be made to U.S. Pat. No. 5,967,702 and CA2236062, wherein is described a pit prop having two opposed ends and comprising two bearing plates located at the ends, two telescopically displaceable prop elements, a number of separate resiliently compressible rubber discs arranged adjacent one another and a tubular indicating element. The prop includes a further bearing plate with the discs being located between two bearing plates to permit yielding of the pit prop under a load. The indicating element has markings thereon to indicate the load condition of the prop. The prop includes a locking device for releasable locking the prop elements with respect to one another.

The drawback of the above said U.S. patent is that the rubber discs may be affected by weathering condition and also will have more wear and tear under repeated loading. Also the prop is a non-yielding rigid prop which is meant for fixed preloading only.

Reference may be made to patent no. GB822162, entitled as "Improvements relating to hydraulic pit props" disclosing a hydraulic pit prop provided with a spring-loaded valve of flow cross-section opening in the direction of liquid pressure and operable either by the liquid pressure to relieve excess pressure in the prop or manually though a longitudinally displaceable rod to initially release the pressure when the prop is to be withdrawn, the valve being interconnected, with axial play, by the rod with a spring-loaded main release valve which opens in the direction opposite to the pressure in the prop, and can be manually opened by means of the rod after the valve has first been opened to initially release the pressure. The coupling between the rod and the valve which comprises a piston on the rod guided in a closed chamber in the influence of liquid pressure in a liquid supply conduit adapted to be connected to the valve casing when the prop is to be set, the valve in this case acting as a non-return valve for the liquid being pumped into the prop.

Reference may be made to patent no. GB2368860, entitled as "Hydraulic prop and seal arrangement" disclosing a hydraulic cylinder especially for use as a pit prop or moving cylinder unit underground, has a locking ring arranged on an outer cylinder tube sealing it at its end with a lead through for an axially movable rod element. The locking ring is provided in the lead through with a sealing arrangement resting on the outer side of the rod element. The sealing arrangement has a guide ring provided with grease grooves open to the outer side of the rod element which can be supplied with lubricant via a lubricant line accessible on the outside of the hydraulic cylinder. The gap formed between an outer collar and the rod element is than the between the rod element and an inner collar.

Reference may be made to patent no. GB1037686 entitled as "Hydraulic operated mine prop, wherein a hydraulic pit prop is disclosed in which at least the external prop member for guiding the sealing portion of the prop piston consists of a longitudinally welded tube. In so far as the sealing member is so selected to accommodate misalignment or relative canting of the prop member then the latter may be made from cheap welded tube stock as opposed to being made from accurately worked, seamless drawn or rolled precision tubes as heretofore. The prop is provided with a retraction spring and the seal with a tensioning sleeve.

Reference may be made to patent no. US2002031407, titled: Prop device for mining and tunnel construction which consists of an inner pipe and an out pipe which can be moved while inserted in each other. The pulling apart motion is initiated when a liquid is filled into a filler opening into the outer pipe whose cavity is separated from the cavity by a plate. This plate features a weak point. Endangerment of the workers is therefore eliminated. After the extension of the inner pipe from the outer pipe the partial wedges are pushed into remaining narrow gap so that the desired locking effect takes immediately place. The water or liquid can exit again from the cavity via the filler opening. A very light prop device that absorbs sufficient straining forces has been created.

Reference may be made to patent no. GB864032, entitled as "Improvements relating to hydraulic pit props or the like" wherein the hydraulic pit prop comprises two telescoping parts which are extended by a differential piston operated by rotating a lever through 180 degrees, and are released by rotating the lever through the remaining 180 degree to open, by means of a projection on the piston, a bolt valve and subsequently a valve member. The prop is first extended by a low-pressure piston and, when its relief valve operates, is set by a high pressure piston. A pressure relief valve is provided.

Reference may be made to patent no. GB742701 as entitled as "Improvements in or relating to telescopic pit-props" wherein the telescoping parts of a pit-prop are locked by independent wedges in slots in a prop lock with or without the interposition of a locking element. The keys are of light alloy are engaged by a galvanized surface on the wedges. The inner prop member may be of double H section having brake shoes adapted to be gripped between the flanges of the inner member by operation of wedges action on both sets of flanges by means of keys. In a modification, each wedge and one key operates on one set of flanges only. For instantaneous withdrawal of the prop an eccentric may be provided or two wedges connected by a sleeve passing over the tapered ends. Reference may be made to patent no. GB948255 entitled as "Improvements in or relating to hydraulic pit props", wherein the hydraulic pit prop as disclosed is provided with a sealed outer guard tube defining with the cylinder an annular gap which communicates by means of a port with annulus between the piston and cylinder unit the arrangement being such that contraction of the prop is not adversely affected by pneumatic pressure variations in the annulus. The prop is provided with a chamfered base plate bolted thereto. The guard tube may be of corrugated form.

Reference may be made to patent no. GB947516 entitled as "Improvements in or relating to pit props", wherein the hydraulic pit prop incorporates an auxiliary piston pressurized by an accumulator which supplies pressure for retraction purposes and is charged during extension of said prop. The piston is fixed to the base of the prop and slides in a cylinder, which is fixed to the member therefore and communicates with the accumulator through parts. The accumulator is made of spring steel, plastic or rubber and is mounted in a steel housing. The member is elevated by a pump which feeds liquid from the reservoir through a conduit and valves to a chamber, the underside of the being initially fed with liquid through a valve and then fed with liquid through a valve in the piston. A release valve permits escape of liquid from the chambers to the reservoir when the prop is to be released.

Reference may be made to patent no. GB946631 entitled as "Improvements in or relating to mine-roof supports", wherein the telescopic pit prop consisting of parts of angular cross-section are interlocked by a tilting ring or clamps comprising pivoted components urged apart by a connected to a double-acting hydraulic jack by arms.

Reference may be made to patent no. GB942471 entitled as "Improvements in or relating to hydraulic roof supports for mines", wherein the hydraulic pit prop is made up from a number of units each consisting of a rubber ring bonded to steel plates, the units being bolted together and to a control ring provided with inlet, exhaust and relief valves. One plat of each end unit comprises a flanged base or roof support element. In a modification, the prop consists of alternate layers of rubber and steel ring bonded together, one ring acting as a control ring and each end ring as a roof or base plate.

Reference may be made to U.S. Pat. No. 3,992,888 entitled as "Hydraulic pit prop", wherein the pit prop comprises an elongated skid adapted to lie on the floor and having a front end link able to a support such as a face conveyor. A pair of generally parallel elongated feet flank the skid and each have a front portion, which is substantially twice as wide as its rear portion. A slide fluid cylinder has a rear end secured of the skid and a front end secured to a cross member attached to the front portions of the feet so that extension or contraction of the slide cylinder displaces the feet relative to the support. A pair of support arms each has a rear end loosely pivoted on the rear portion of the respective foot and a front end carrying a roof-engaging shield. A loft cylinder extends between each foot front portion and the respective front end of the respective arm for pressing the shield against the mine roof and the feet against the mine floor.

Reference may be made to U.S. Pat. No. 402,889 entitled as "Pit prop assembly", wherein the pit prop assembly has two pit props with parallel laterally spaced bases each having a front end turned towards a face conveyor and a rear end turned away from the face conveyor. A slide has its front end connected via positioning mechanism to the conveyor and its rear end connected via hydraulic ram to the bases. Each of the bases has at its rear end a side turned toward a confronting side on the slide and forming a side pair with this confronting side. One of these sides is formed with a formation that engages over and under another formation on the other side. One of these formations of each of the pairs of formation extends longitudinally toward the face so that the two formations can slide relative to each other. One of these formations may also be a pin whereas the other is a groove, or one may be a pair of facing convex surfaces flanking a straight edge.

Reference may be made to patent no. 2454 DEL 95 disclosing a device of support 'Pit Prop', which has been developed, and already being used by the mines. It is made up of two pair of steel tubes and a crown. The bottom tubular portion needs a piece of wooden log to be inserted to adjust with the height of mine roofs. A different size of log/piece of timber is required every time to suit the roof height and at the same time a wooden wedge is required at the bottom to tighten the prop rigidly on the ground against the roof. As the wedge is tightened by manual hammering it is not possible to provide a setting load of more then 200-500 Kg. Further, one needs shaping of wooden pieces of different length and thickness to adjust with the roof height from the crown of the prop. It is always difficult and time taking for making a suitable wooden logs for each prop at time of erection, which are hardly used without rework afterwards. Thus, wooden pieces/timbers are paramount for this type of support, which can not be eliminated. Again, wooden wedges, after getting it tightened are responsible for inclination from vertically, which creates eccentricity problem with roof. In addition, yielding characteristic is not available in this pit prop.

Reference may be made to patent nos. GB 968810(A), GB 994903 (A), GB 846291 (A), & GB 699913 (A), entitled as 'Friction prop' which is also being used by the mines. The device described herein can provide setting load, height variation and yielding characteristic. The yielding characteristic of friction prop depends upon the frictional forces developed between the outer surface of the inner tube and the inner surface of the vice arrangement provided on the outer tube. Again this frictional force developed depends upon the how perfectly wedges are tightened in the vice arrangement. Further, these friction props are very heavy to handle as they are in a single unit. At the same time remote withdrawal is not possible. If frictional part of the outer surface of the inner tube got damaged it can never be replaced and hence whole prop would be of no use. At the last it does not have load-monitoring device to monitor the upcoming load of roof.

Reference may be made to U.S. Pat. No. 5,967,702 entitled as "Quick-release pit prop". The pit prop has two opposed ends and comprises two bearing plates located at the ends, two telescopically displaceable prop elements, a number of separate resiliently compressible rubber discs arranged adjacent each other and a tubular indicating element. The prop includes a further bearing plate with the disc being located between two bearing plates to permit yielding of the pit prop under a load. The indicating element has marking thereon to indicate the load condition of the prop. The prop includes a locking device for releasable locking the prop elements with respect to each other.

Reference may also be made to Indian patent No. 1026 DEL 2004 in which the yielding mechanism is a compression helical spring inserted in top tube resting between fixed bottom base and a circular plate on top of the helical spring. Circular plate supports the hollow square canopy through which roof load is transmitted.

In the above-referred props some of the drawbacks are:

a) Longevity of the props is less as the yielding element rubber may be affected by weathering condition as also faster wear and tear.
b) No facilities for giving proper setting load which is a vital parameter to be considered.
c) Roof support area is a point roof support, instead of broad area.
d) Simplest quick release system from a safe distance is not provided.
e) Lack of facility for easy dismantling and good portability.
f) No device to monitor the yielding as well as roof load
g) No facility for replacement of yielding mechanism h) No facilities for varying the yielding range as in the case of helical spring amount of yielding is fixed.

From the survey of hitherto known prior art it is seen that there is scope for improvement and hence there exists a definite need for providing a device useful for supporting underground mine tunnels/roadways.

OBJECTS OF THE PRESENT INVENTION

The main object of the present invention is to provide a device useful for supporting underground mine/tunnels/roadways, which will replace timber completely thus maintaining ecological balance.

Another object of the present invention is to provide a device useful for supporting underground mine/tunnels/roadways, wherein no wedging is required.

Yet another object of the present invention is to provide a device useful for supporting underground mine tunnels/roadways, wherein setting load can be provided.

Yet another object of the present invention is to provide a device useful for supporting underground mine tunnels/roadways, wherein all the parts are detachable thus easily transportable, which can be easily installed and dismantled quickly.

Yet another object of the present invention is to provide a device useful for supporting underground mine tunnels/roadways, wherein height variation can be possible.

Yet another object of the present invention is to provide a device useful for supporting underground mine tunnels/roadways, which will provide yielding characteristic.

Yet another object of the present invention is to provide a device useful for supporting underground mine tunnels/roadways, wherein easy withdrawal is possible, even from a remote distance.

Yet another object of the present invention is to provide a device useful for supporting underground mine tunnels/roadways, which provides for continuous monitoring of roof load, thus avoiding a separate measuring instrument.

Yet another object of the present invention is to provide a device useful for supporting underground mine tunnels/roadways, which is compact, robust and requires minimal maintenance, thus very cost effective and economically viable.

Yet another object of the present invention is to provide a replaceable yielding mechanism that will save time and money for procurement of new prop.

Still another objective is to variance in yielding range by rearrangement of yielding mechanism.

Yet another objective of the present invention is to provide smooth and easy yielding.

Still another objective of the present invention is to have more longevity maintenance proof yielding mechanism.

Still another objective is to provide simple, easy and safe remote release mechanism

SUMMARY OF THE INVENTION

Accordingly the present invention provides a device for roof support of underground mine/tunnel, comprising in combination a top tubular element (1) being inserted telescopically in a bottom tubular element (2) by means of a lock nut (6) and a load setting clamp (7); wherein the top portion of the said top tubular element being attached to a spring holding element (3) having a disc spring (5), a pointer (13) being attached at the top of the said disc spring to indicate the load, a square section canopy (9) being coaxially placed at the top of the said spring holding element to bear the load, a detachable holding clamp (4) having remote release mechanism being provided at the bottom of the said top tubular element by means of a long handle (11) and a detachable jack setting clamp (10) being provided at the top of the said bottom tubular element; wherein twin jacks (8) being provided between the said clamps (7 & 10) to lift the top tubular element during the operation.

In one embodiment of the present invention the detachable holding clamp (4) and the long handle (11) is having a matching internal threading with the external threads on the bottom portion of the top tubular element (1).

In another embodiment of the present invention the load setting clamp (7) and the lock nut (6) is having a matching internal threading with the external threads of the top tubular element (1).

In another embodiment of the present invention the external and internal threading is of the same matching pitch.

In another embodiment of the present invention a device wherein the openable holding clamp (4) with remote release mechanism and rotatable long handle (11) is having matching internal threading with the external threads on the bottom portion of the top tubular element (1).

In yet another embodiment of the present invention the disc spring can be rearrange to vary the yielding range and capacity of the device as per requirement.

In yet another embodiment of the present invention the disc spring is used to provide longevity to the device.

In yet another embodiment of the present invention the device has quick release mechanism from a safe distance.

In yet another embodiment of the present invention a device wherein the detachable holding clamp (7) and lock nut (6) are both having internal threading matching the external threads of the top tubular element (1).

In yet another embodiment of the present invention a device wherein the external and internal threading is of same matching pitch.

In still another embodiment of the present invention a device wherein the disc spring is fitted with a convergence measurement pointer.

BRIEF DESCRIPTION OF DRAWINGS

The present invention as described in FIGS. 1 to 20 of the drawings accompanying this specification.

FIGS. 9 & 9A shows the elevation and plan view of disc spring meant for yielding.

FIG. 10 is the remote release long handle.

DETAILED DESCRIPTION OF THE PRESENT INVENTION

Figure 1:
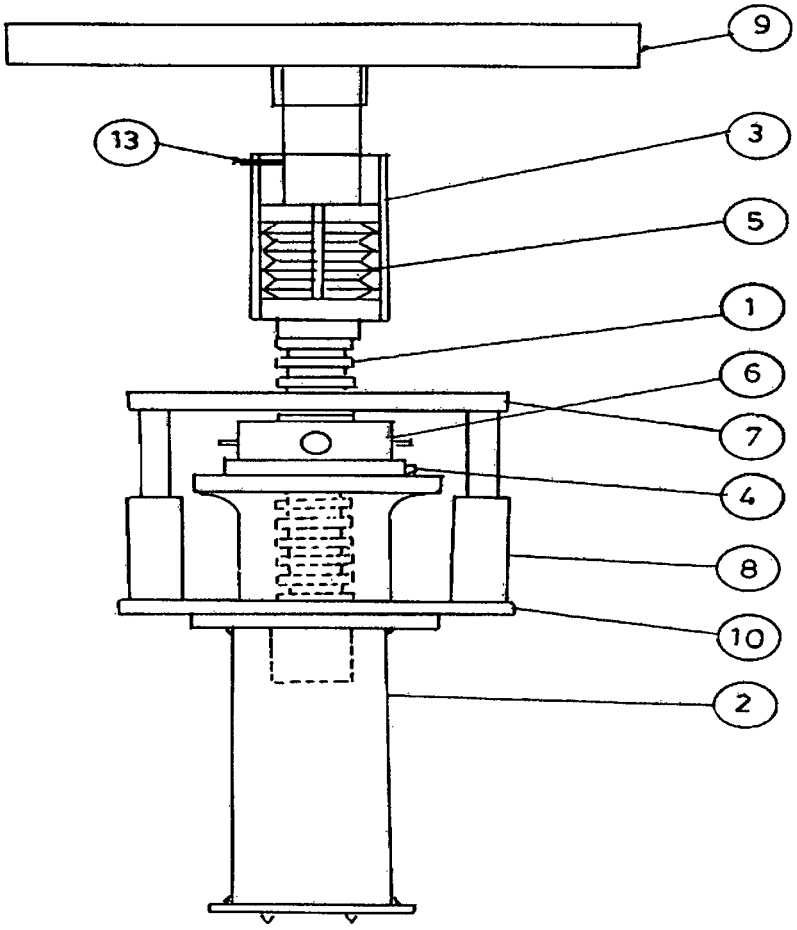
FIG. 1 shows the schematic diagram of the device of the present invention in assembled condition.
Figure 2:
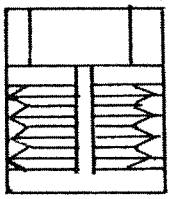
FIG. 2 shows the set of disc spring meant for yielding mechanism.
Figure 3:
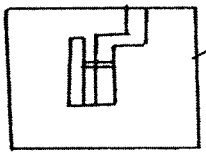
FIG. 3 shows roof load indicator with pointer for convergence measurement of the prop.
Figure 4A:
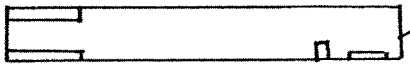
FIGS. 4 & 4A depicts the load setting clamp in two views plan and elevation respectively.
Figure 4:
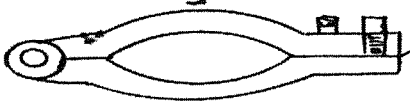
Figure 5A:
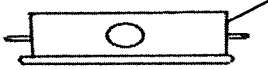
FIGS. 5 & 5A shows the corresponding views of plan and elevation of lock nut.
Figure 5:
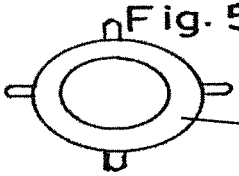
Figure 8:
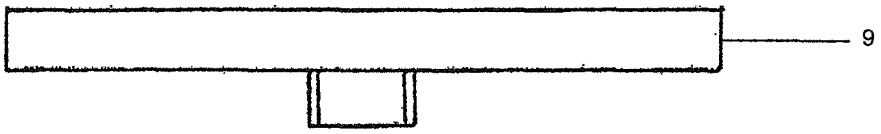
FIG. 8 is the square section canopy of the prop.
Figure 6A:
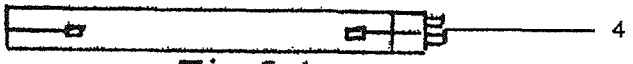
FIGS. 6 & 6A denote the plan and elevation of holding clamp.
Figure 6:
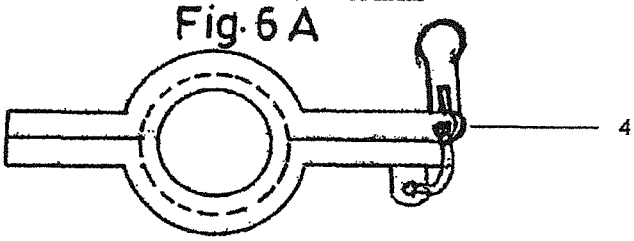
Figure 7A:
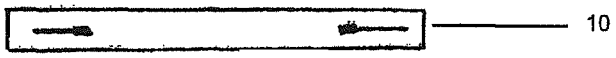
FIGS. 7 & 7A depicts jack setting clamp.
Figure 7:
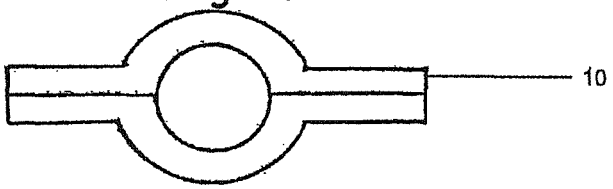

The various parts of the present invention as shown in the FIGS. 1, 9, 9A and 10 of the drawing accompanying this specification are:

1) Top tubular externally threaded element.
2) Bottom tubular element having bracket to rest twin hydraulic jack and holding clamp.
3) Tubular spring holding element.
4) Detachable holding clamp having remote release mechanism.
5) Set of disc spring.
6) Lock nut.
7) Top load setting clamp having internal threading matching the external thread of the top tubular element (1).
8) Twin jacks.
9) Square section canopy.
10) Bottom load setting clamp for jack setting.
11) Remote release long handle.
12) Disc spring (two views).
13) Convergence/Roof load indicator.

The above said parts in combination comprise the device of the present invention useful for supporting underground mine tunnels/roadways.

In the present invention there is provided a device useful for supporting underground mine tunnels/roadways. The device of the present invention consists of an externally threaded top tubular element, which is capable of being inserted telescopically into a bottom tubular element having external threads on the top portion. An detachable holding clamp having internal threading matching the external threads of the bottom tubular element is provided for coaxially placing set of disc springs and a tubular spring holding element on threaded part of the said bottom tubular element. The top tubular externally threaded element is providing with a lock nut having matching internal threads. The said lock nut is placed touching the top of the disc springs inside the tubular spring holding element on threaded part of the said bottom tubular element. On the top tubular element, above the said lock nut, a top load setting clamp having internal threading matching the external threads of the top tubular element is provided for holding twin jacks placed between two load setting clamps, one clamp on the bottom tubular element and the other clamp on the top tubular element.

The novelty of the device of the present invention useful for supporting underground mine tunnels/roadways are that it is compact, is of robust construction which requires minimal maintenance, and hence is very cost effective, thus economically viable. It provides for continuos monitoring of convergence of the roof. Further, all the parts are detachable thus easily transportable, installation is very easy, dismantling is quick and it also provides height variation, setting load, yielding characteristic, ease of withdrawal even from a remote distance, provision for variation of yielding range and simple, easy and safe remote release.

The non-obvious invention steps which enable the novelty of the device of the present invention comprises in combination the parts such as the top tubular externally threaded element, the bottom tubular element with remote release mechanism, the disc spring, the tubular spring holding element, the lock nut, the detachable holding clamps having matching internal threading and the twin jacks. The above said parts provide in combination the novel device of the present invention useful for supporting underground mine tunnels/roadways.

In actual practice the operation of the device of the present invention useful for supporting underground mine tunnels/roadways, is as detailed below:

The top tubular element (1), the bottom tubular element (2), the top tubular element (1) along with disc spring (5), the lock nut (6) and both the clamps (4) and (7) along with twin jacks (8) can be separately transported to the site of support erection. The bottom structure (2) would be placed horizontally on the floor first. Then tubular element (1) having outer thread at the bottom and tubular spring holding element (3) along with disc spring (5) will be placed on the clamp (4). Then that the top tube (1) along with lock nut (6) will be inserted in the bottom tube (2) then the other clamp (7) will be clamped on the top tube (1).

EXAMPLES

The following examples are given by way of illustration of the working of the invention in actual practice and therefore should not be construed to limit the scope of the present invention.

Example-1

Figure 11:
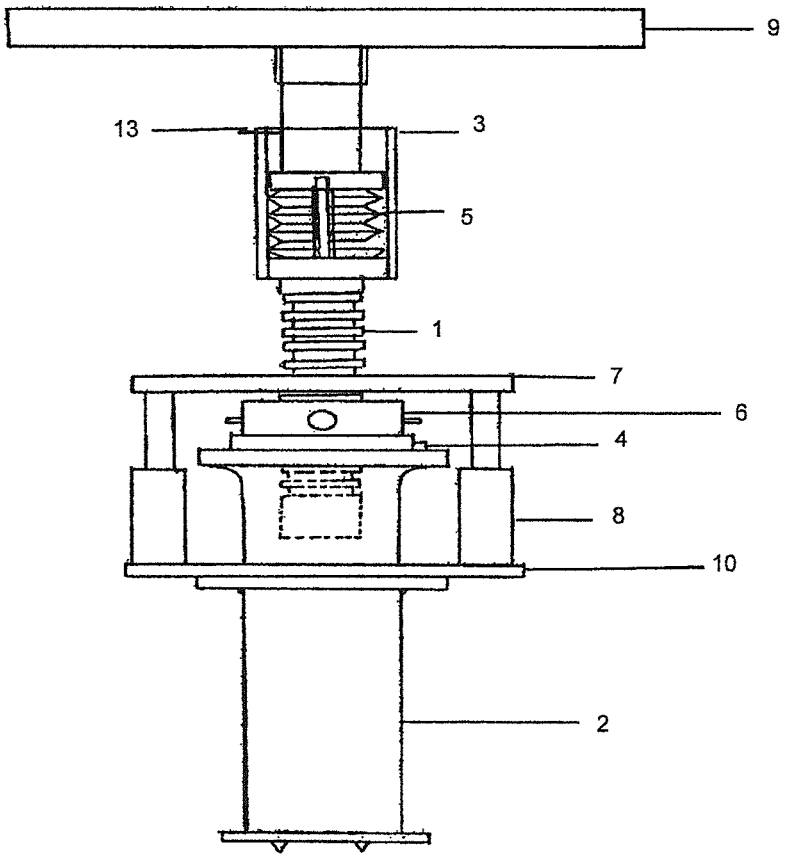
FIG. 11 denotes prop under setting loading.
Figure 12:
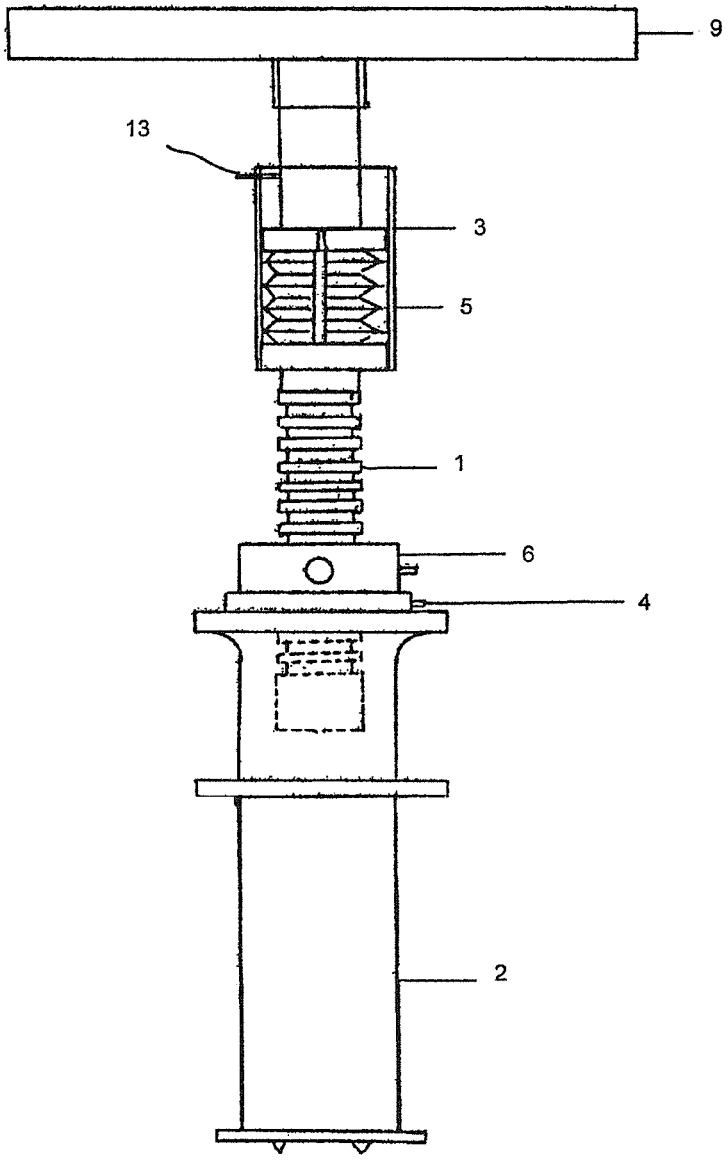
FIG. 12 shows prop under roof loading.
Figure 13:
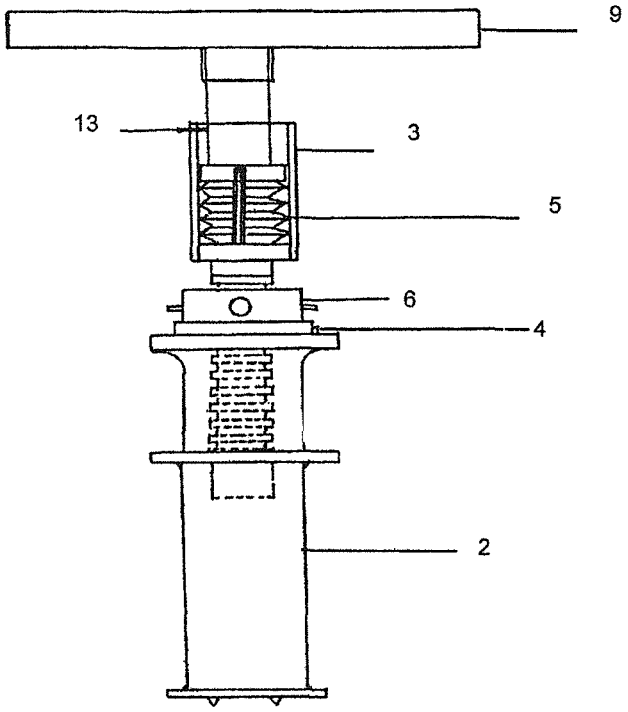
FIG. 13 depict the prop under no load condition.
Figure 14:
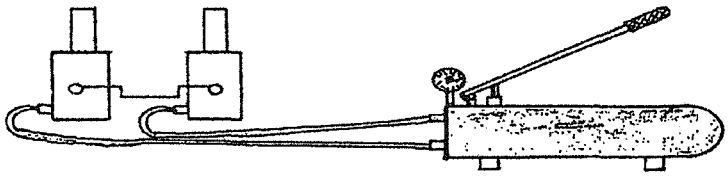
FIG. 14 indicate prior art twin jacks which are used in applying setting load.
Figure 15:
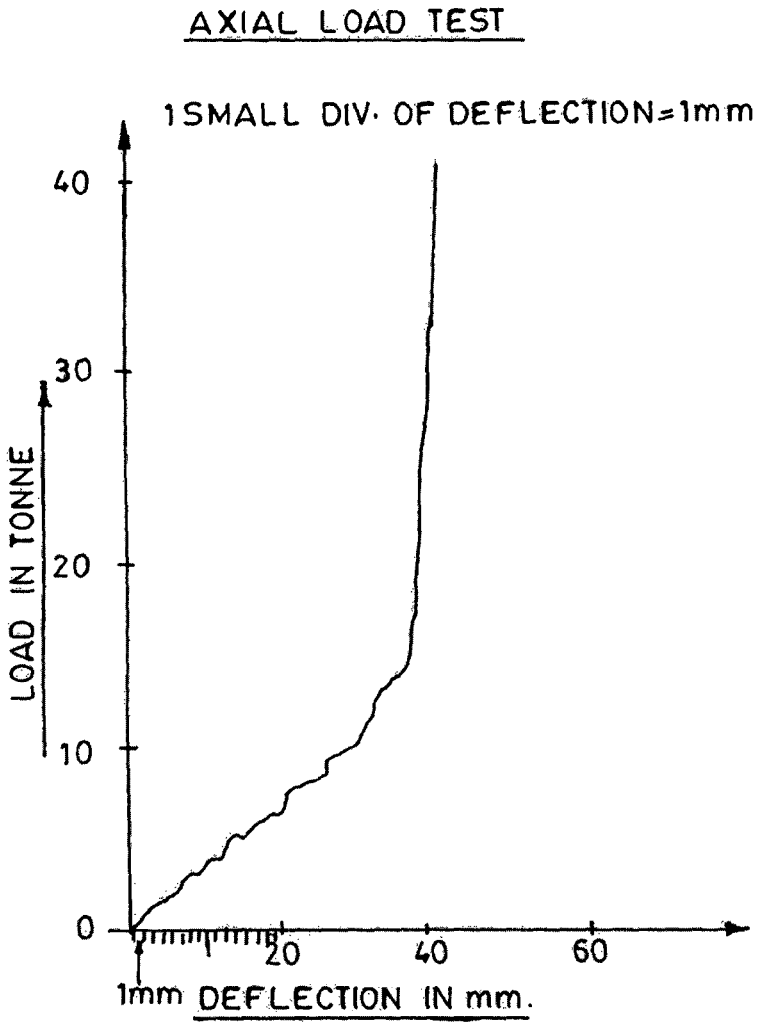
FIGS. 15, 16 & 17 are the characteristic curves for axial load, eccentric load and overload test respectively.
Figure 16:
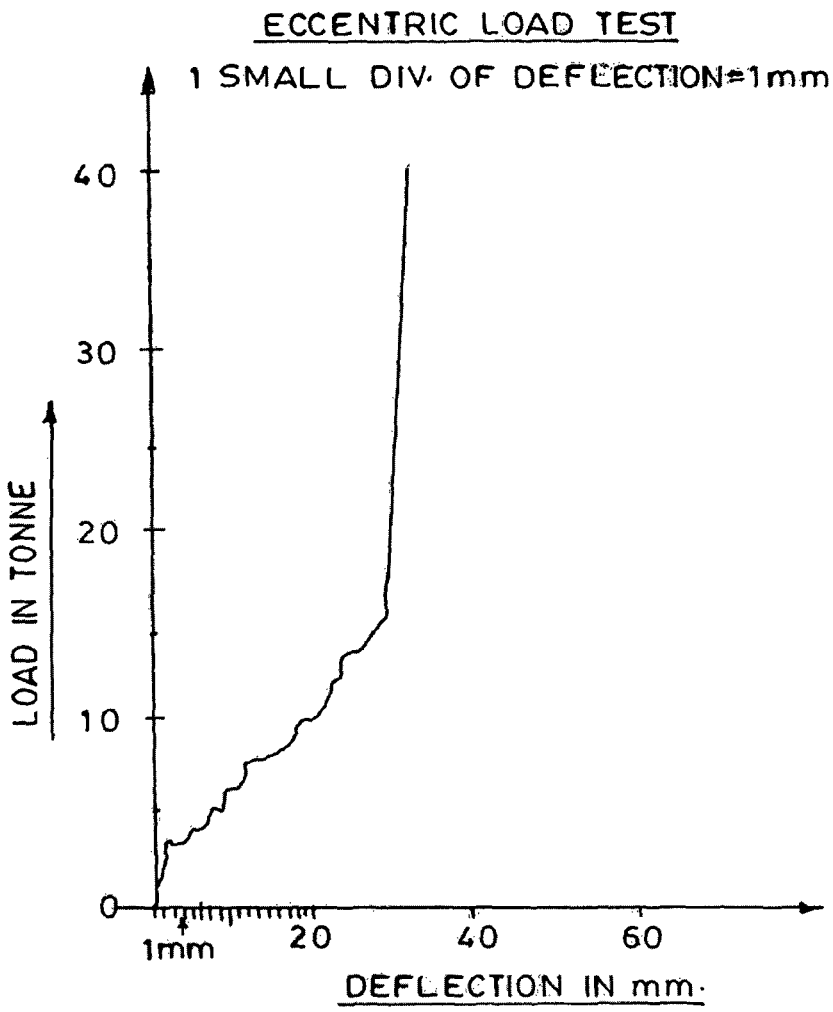
Figure 17:
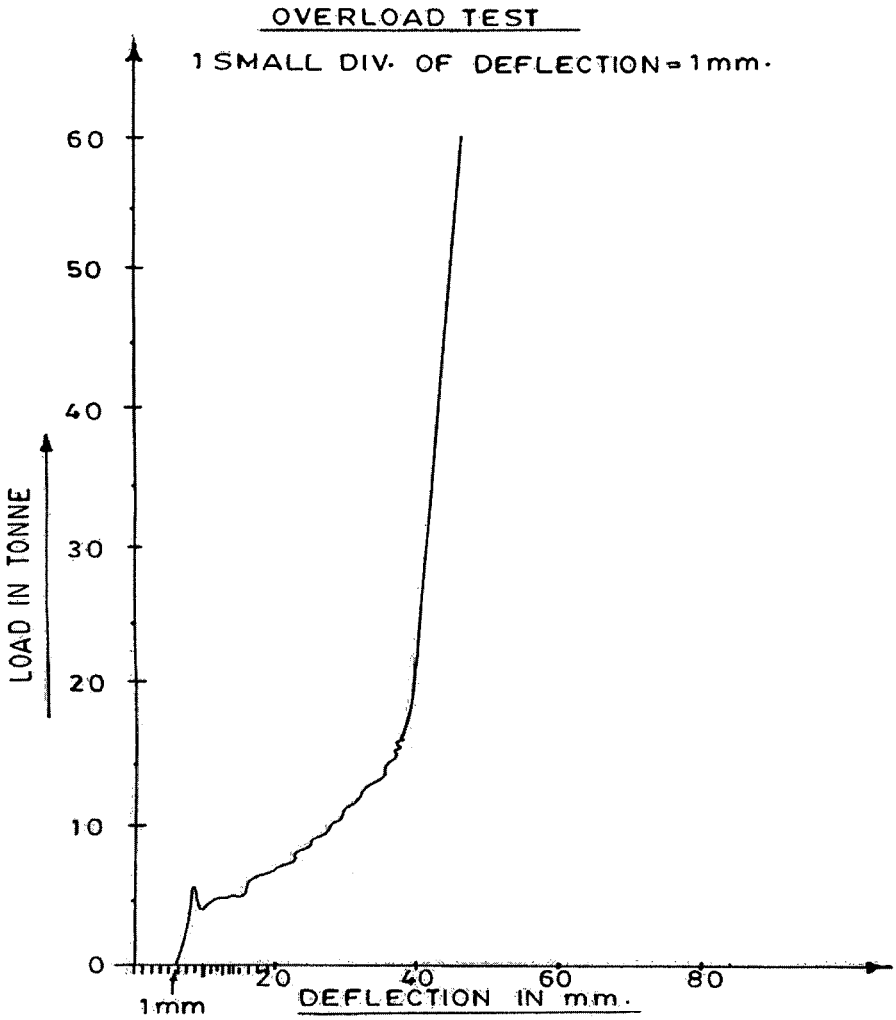
Figure 18:
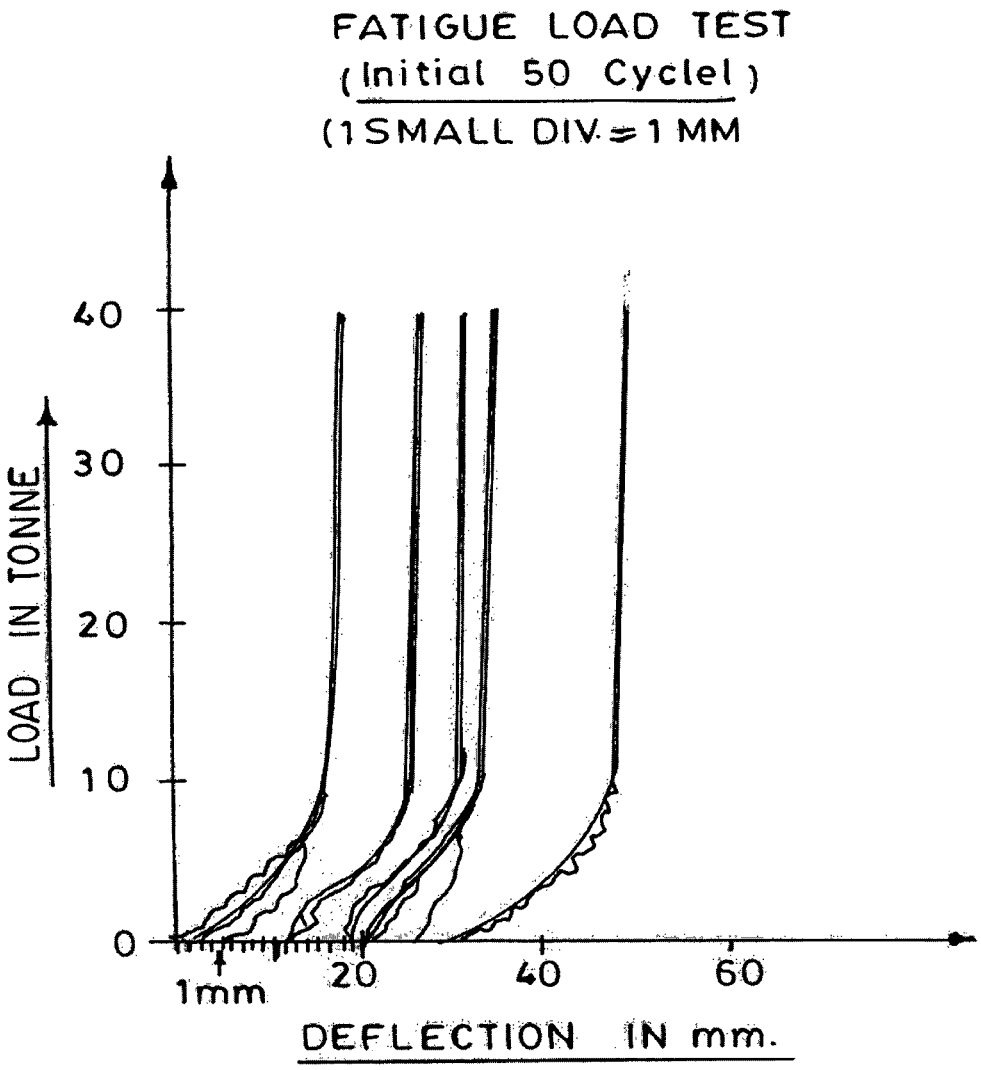
FIGS. 18, 19 & 20 are the characteristic curves for fatigue load test for 500 cycles (three segments of 50 cycles each).
Figure 19:
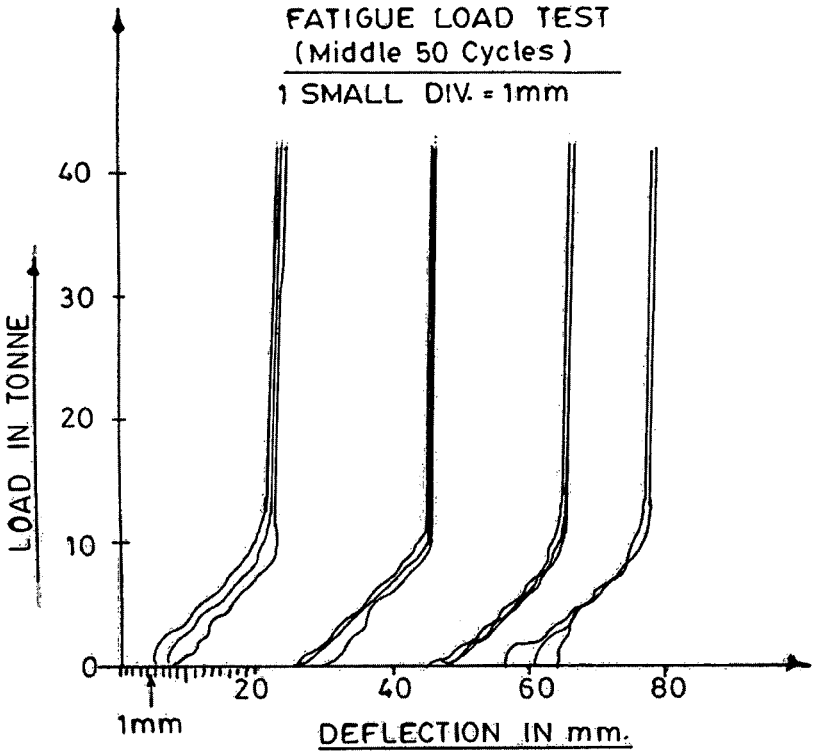
Figure 20:
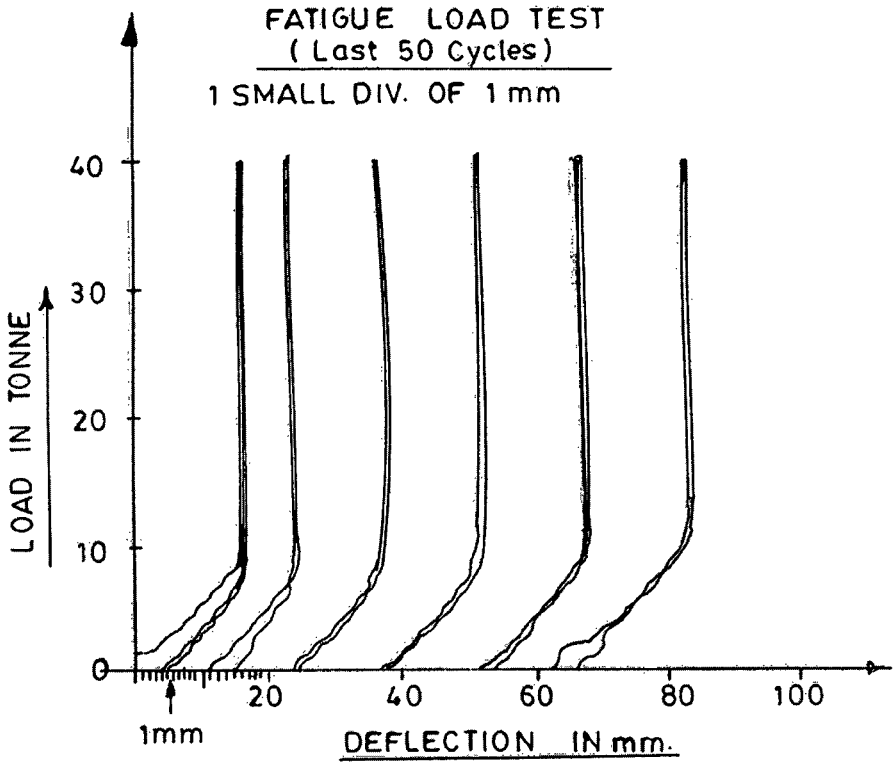

This device useful for support of underground mine tunnel/roadways in accordance with the specification were manufactured as mentioned in the drawings accompanying this specification. Laboratory trial was conducted at CIMFR Laboratory on the advice of Directorate General of Mines Safety (DGMS), a statutory body of Govt. of India/ECL. FIGS. 11, 12, & 13 depict the three conditions of prop i.e. prop under setting load, prop under roof load and no load respectively. In FIGS. 15, 16 and 17 there are characteristic curve for axial load test, eccentric load test and overload test respectively. In addition to that fatigue load test was also conducted for 500 cycles and characteristic curve thereof have been shown for initial, middle and last 50 cycles respectively in FIGS. 18, 19 & 20. Field trials were conducted thereafter in Chinakuri Mine-1 Eastern Coalfields Limited (ECL), Sanctoria, Burdwan (West Bengal) in longwall panel and development district. The observation of the systematic field trial is as under.

The device is erected vertically so that it can touch the mine roof. Then twin jacks (8) will be placed between the two clamps (10) and (7) and the pump of the twin jacks (8) will be operated to extend the ram of the jack for lifting up the tubular structure (1) against the roof. When the induced load to the tubular structure (1) will be around 5 tonnes, the lock nut (6) will be tightened against the holding clamp (4), exerting a reaction force through the top tube (1) against the spring (5). Once the prop is set, the jacks (8) along with the top clamp (7) and bottom clamp (10) will be withdrawn from the site. During loading, the load will come through the top tube (1) to the disc spring (5) through lock nut (6) and then transmit to the bottom tube (2) through the holding clamp (4). As the load increases, the spring will be compressed, which in turn facilitates the yielding of the prop. During withdrawal, the holding clamp (4) will be opened from a safe distance by lifting the arm and rotating the nut by long handle (11) through which connecting lever expends outwardly and facilitates the opening of the clamp, therefore allowing tubular structure (3), disc spring (5) and top tube (1) with lock nut (6) to fall down. During entire loading condition, the roof load coming on the canopy (9) and transmitted to the prop and then convergence of the roof can be measured with the help of a pointer (13) attached with the disc spring (5) & (12).

It was found that the device gave satisfactory results under critical field trial observation for 6 (six) months. Versatility of the device such as replaceable yielding mechanism, easy transportable due to all parts detachable, easy withdrawal from a remote and safe distance, upcoming roof load/convergence measurement etc. were monitored and found satisfactory.

ADVANTAGES

1. It replaces timber completely thus maintaining ecological balance.
2. No wedging is required.
3. Setting load can be provided.
4. Installation is very easy.
5. Dismantling is quick.
6. Height variation is possible.
7. Provides yielding characteristic.
8. Easy withdrawal possible, even from a remote distance.
9. All the parts are detachable thus easily transportable.
10. Longevity of the prop by changing element(s) of yielding spring only, if required.
11. Very compact and robust.
12. Minimum maintenance.
13. Very cost effective, thus economically viable.
14. Roof load coming as well as convergence of the roof can be continuously monitored with the help of the pointer attached with the disc spring. Thus no separate measuring instrument is required for this purpose.
15. Variable yielding range
16. Simple, easy and safe remote release mechanism.

We claim:

1. A device for roof support of underground mine/tunnel, comprising in combination a top tubular element being inserted telescopically in a bottom tubular element by means of a lock nut and a detachable top load setting clamp; wherein the top portion of the said top tubular element being attached to a spring holding element having a disc spring, a pointer being attached at the top of the said disc spring to indicate the load, a square section canopy being coaxially placed at the top of the said spring holding element to bear the load, a detachable holding clamp having remote release mechanism being provided at the bottom of the said top tubular element by means of a long handle and a detachable bottom load setting clamp being provided at the top of the said bottom tubular element; wherein twin jacks being provided between the top and bottom load setting clamps to lift the top load setting clamp so as to lift the top tubular element during the operation, wherein in use the lock nut rests on the detachable holding clamp and transmits load from the top tubular element to the detachable holding clamp, and the detachable holding clamp rests on the bottom tubular element and transmits load from the lock nut to the bottom tubular element.

2. The device as claimed in claim 1, wherein the detachable holding clamp and the long handle is having a matching internal threading with the external threads on the bottom portion of the top tubular element.

3. The device as claimed in claim 1, wherein the top load setting clamp and the lock nut is having a matching internal threading with the external threads of the top tubular element.

4. The device as claimed in claim 3, wherein the external and internal threading is of the same matching pitch.

5. The device as claimed in claim 1, wherein the disc spring can be rearranged to vary the yielding range and capacity of the device as per requirement.

6. The device as claimed in claim 1, wherein the disc spring is used to provide longevity to the device.

7. The device as claimed in claim 1, wherein the device has quick release mechanism from a safe distance.

8. The device as claimed in claim 1, wherein the load setting clamp and the lock nut have a matching internal threading with external threads of the top tubular element; the lock nut is threaded onto the external threads of the top tubular element; and the top load setting clamp comprises two half-nuts with the internal threading that in use close onto the external threads of the top tubular element.

9. The device as claimed in claim 1, wherein the detachable holding clamp is movable between a clamped position in which it engages the top tubular element and transmits the load from the lock nut to the bottom tubular element, and an open position in which it can be removed from the top tubular element; and wherein removing the detachable holding clamp permits the lock nut to drop into the bottom tubular element.

10. A device for roof support of underground mine/tunnel, comprising in combination a top tubular element being inserted telescopically in a bottom tubular element by means of a lock nut and a detachable top load setting clamp; wherein the top portion of the said top tubular element being attached to a spring holding element having a disc spring, a pointer being attached at the top of the said disc spring to indicate the load, a square section canopy being coaxially placed at the top of the said spring holding element to bear the load, a detachable holding clamp having remote release mechanism being provided at the bottom of the said top tubular element by means of a long handle and a detachable bottom load setting clamp being provided at the top of the said bottom tubular element;

wherein the detachable top load setting clamp in use engages the top tubular element above the lock nut and below the spring holding element, and wherein twin jacks are provided between the top and bottom load setting clamps so that upper ends of the twin jacks lift the top tubular element during the operation by lifting the detachable top load setting clamp, thereby compressing the disc spring.

11. The device as claimed in claim 10, wherein the detachable holding clamp and the long handle is having a matching internal threading with the external threads on the bottom portion of the top tubular element.

12. The device as claimed in claim 10, wherein the detachable top load setting clamp and the lock nut is having a matching internal threading with the external threads of the top tubular element.

13. The device as claimed in claim 12, wherein the external and internal threading is of the same matching pitch.

14. The device as claimed in claim 10, wherein the disc spring can be rearranged to vary the yielding range and capacity of the device as per requirement.

15. The device as claimed in claim 10, wherein the disc spring is used to provide longevity to the device.

16. The device as claimed in claim 10, wherein the device has quick release mechanism from a safe distance.

17. A device for roof support of underground mine/tunnel, comprising in combination:

a bottom tubular element;

a detachable holding clamp supported on the bottom tubular element, the detachable holding clamp being movable between a clamped position around the top tubular element and a released position in which it can be removed from the top tubular element, and having a release mechanism operable remotely by a long handle;

an internally threaded lock nut supported on the detachable holding clamp;

an externally threaded top tubular element inserted telescopically in the bottom tubular element and threadingly engaged and supported by the lock nut;

a spring holding element having a disc spring attached to a top portion of the top tubular element, wherein the disc spring can be rearranged to vary the yielding range and capacity of the device as per requirement;

a pointer attached at the top of the disc spring to indicate a load on the device;

a square section canopy coaxially placed at the top of the spring holding element to bear the load;

an internally threaded detachable top load setting clamp that comprises two half-nuts with internal threading that during a setting operation is provided to close onto the external threads of the top tubular element between the lock nut and the spring holding element;

a detachable bottom load setting clamp that during the setting operation is provided to engage the bottom tubular element;

twin jacks that during the setting operation are provided to lift the detachable top load setting clamp so as to lift the top tubular element;

wherein during the setting operation the lock nut is screwed down to rest on the detachable holding clamp;

wherein after the setting operation the lock nut transmits load from the top tubular element to the detachable holding clamp, and the detachable holding clamp transmits load from the lock nut to the bottom tubular element, whereby after the setting operation the detachable top and bottom load setting clamps and the jacks can be removed; and wherein to release the detachable holding clamp, the detachable holding clamp is released from a safe distance using the long handle, permitting the lock nut and the top tubular element to drop into the bottom tubular element.

* * * * *